US011198526B2

(12) United States Patent
Burken et al.

(10) Patent No.: US 11,198,526 B2
(45) Date of Patent: Dec. 14, 2021

(54) ROTARY LID FEEDING FOR OVERCAPPER APPLICATIONS

(71) Applicant: R.A Jones & Co., Covington, KY (US)

(72) Inventors: Wade Joseph Burken, Dewitt, IA (US); Donald Brooks MacKinnon, Fairfield, OH (US); Daniel Leonard Matthies, Bettendorf, IA (US); Jeffrey David Wintring, Florence, KY (US)

(73) Assignee: R.A Jones & Co., Covington, KY (US)

( * ) Notice: Subject to any disclaimer, the term of this patent is extended or adjusted under 35 U.S.C. 154(b) by 443 days.

(21) Appl. No.: 15/672,402

(22) Filed: Aug. 9, 2017

(65) Prior Publication Data

US 2018/0057194 A1 Mar. 1, 2018

Related U.S. Application Data

(60) Provisional application No. 62/372,346, filed on Aug. 9, 2016.

(51) Int. Cl.
*B65B 7/28* (2006.01)
*B65B 65/00* (2006.01)

(52) U.S. Cl.
CPC ..... *B65B 7/2807* (2013.01); *B65B 65/006* (2013.01)

(58) Field of Classification Search
CPC ..... B65B 7/2807; B65B 65/006
See application file for complete search history.

(56) References Cited

U.S. PATENT DOCUMENTS 2,954,900 A * 10/1960 Brubaker ..... B65B 7/2807 221/211
3,741,366 A * 6/1973 Van Melle ..... B65G 47/1471 198/400
4,040,513 A * 8/1977 Walls ..... B05B 13/0235 198/530
4,122,649 A 10/1978 Sawvel
4,312,172 A * 1/1982 Fisher ..... B65B 7/2807 221/14
4,683,706 A * 8/1987 Harper ..... B65B 7/285 53/314
4,691,501 A 9/1987 King
4,896,480 A * 1/1990 Blumle ..... B65B 7/28 53/313
4,959,944 A * 10/1990 Heisler ..... B65B 7/2807 221/212

(Continued)

OTHER PUBLICATIONS

U.S. Patent and Trademark Office, International Search Report and Written Opinion in PCT Application No. PCT/US2017/046049, dated Oct. 25, 2017.

*Primary Examiner* — Michael Collins
(74) *Attorney, Agent, or Firm* — Wood Herron & Evans LLP

(57) ABSTRACT

An apparatus for dispensing lids has at least one magazine lane including an entrance end, an exit end, and a longitudinal length defined therebetween. The at least one magazine lane further includes a plurality of side guides along the longitudinal length for guiding the lids therebetween and a pair of rollers for carrying the lids thereon. The apparatus further has a throat plate at or near the exit end, the throat plate including an opening. At least one of the throat plate, the side guides, or the rollers is adaptable so as to accommodate different sizes and/or shapes of lids.

18 Claims, 8 Drawing Sheets

(56) References Cited

U.S. PATENT DOCUMENTS

| | | | | | |
|---|---|---|---|---|---|
| 5,050,367 | A * | 9/1991 | Heisler | B65B 7/2807 | 53/313 |
| 5,476,362 | A * | 12/1995 | Kobak | B65G 59/067 | 221/17 |
| 5,931,341 | A * | 8/1999 | Bittermann | B65B 7/2807 | 221/222 |
| 5,960,989 | A * | 10/1999 | Gunderson | B65G 59/106 | 221/220 |
| 6,786,359 | B1 * | 9/2004 | Schroeder | B65B 43/44 | 221/222 |
| 7,270,248 | B2 * | 9/2007 | Schroeder | A47F 1/085 | 221/221 |
| 9,251,640 | B2 * | 2/2016 | Walsh | G07F 11/24 | |
| 10,529,165 | B2 * | 1/2020 | Marquis | G07F 11/24 | |
| 2005/0092767 | A1 * | 5/2005 | Schroeder | A47F 1/085 | 221/208 |
| 2011/0101017 | A1 * | 5/2011 | Schroeder | B65G 59/108 | 221/1 |
| 2014/0175115 | A1 * | 6/2014 | Walsh | G07F 11/24 | 221/222 |

* cited by examiner

ROTARY LID FEEDING FOR OVERCAPPER APPLICATIONS

CROSS REFERENCE TO RELATED APPLICATION

This application claims priority to U.S. Provisional Application No. 62/372,346, filed Aug. 9, 2016, the disclosure of which is incorporated by reference herein in its entirety.

FIELD OF INVENTION

The present invention relates to the field of packaging equipment and methods and, more particularly, to an apparatus and method for feeding individual lids in an overcapper application to be used on a cup filling machine.

BACKGROUND OF THE INVENTION

In packaging equipment it is common for cup filling machines to require a lid be placed on top of a filled cup and then snapped into place to protect the product. These lids can be round, rectangular, or "scround" (i.e., a combination of square and round), and each shape requires a different dispensing method prior to mating with a cup.

In the past, it has been known to load a stack of lids concentrically onto a multi-laned magazine by the machine operator. The lids are then dispensed one at a time to the overcapper station where the lid is located on top of the cup and snapped down over the lip of the cup using a stationary shoe. The magazine, dispensing method, overcapper, and closing shoe can vary with the lid shape. Due to this variation with lid shapes, one common drawback is that this equipment tends to be difficult to set up and maintain, and most machines are only able to feed one style of lid. Thus, these machines must be dedicated to one of round, rectangular, or scround lid and/or tub.

In some known systems, spinning rollers feed the lids into a guillotine style lid feeder, or the lids are axially picked and dropped to feed a single lid from the magazine. The lid then slides down a chute to the location where it will meet up with the cup. This method depends upon gravity, and the chute must be correctly set-up. The lid delivery area set-up is a further known complicating factor.

Another method for non-round static magazines utilizes a cam actuated pick arm. This arm first singulates the lids and then places them directly onto the cup. Again, this method is shape-specific and oftentimes difficult to set up and maintain.

Therefore, a need exists for a new apparatus and method for dispensing lids that are capable of dispensing round, rectangular, or scround lids on the same machine with minimal changeover.

SUMMARY OF THE INVENTION

In one embodiment, an apparatus for dispensing lids has at least one magazine lane including an entrance end, an exit end, and a longitudinal length defined therebetween. The at least one magazine lane further includes a plurality of side guides along the longitudinal length for guiding the lids therebetween and a pair of rollers for carrying the lids thereon. The apparatus further has a throat plate at or near the exit end, the throat plate including an opening. At least one of the throat plate, the side guides, or the rollers is adaptable so as to accommodate different sizes and/or shapes of lids. For example, the throat plate may be a universal throat plate configured to accommodate different sizes and/or shapes of lids in order to provide adaptability to the throat plate. In another embodiment, the throat plate is removably attachable to the at least one magazine lane at or near the exit end thereof such that the throat plate is exchangeable with a different throat plate in order to provide adaptability to the throat plate. In a further embodiment, the side guides are movable relative to each other to adjust a spacing therebetween in order to provide adaptability to the side guides. In yet another embodiment, the rollers are movable relative to each other to adjust a spacing therebetween in order to provide adaptability to the rollers.

In another embodiment, a method of converting an apparatus from a first state wherein the apparatus is configured for dispensing a first plurality of lids to a second state wherein the apparatus is configured for dispensing a second plurality of lids of different sizes and/or shapes than the first plurality of lids, the apparatus including at least one magazine lane having first and second laterally spaced apart elongate members, is provided. The method includes adjusting the lateral spacing between the first and second elongate members to accommodate the second plurality of lids. The method further includes removably attaching a throat plate having an opening configured to accommodate the second plurality lids to the at least one magazine lane such that the throat plate is exchangeable with a different throat plate having a different opening configured to accommodate the first plurality of lids.

In another embodiment, a method of attaching first and second pluralities of lids to corresponding receiving containers, the first plurality of lids each being of a size and/or shape different from that of the second plurality of lids, is provided. The method includes feeding the first plurality of lids to at least one magazine lane, aligning the first plurality of lids to one another, passing at least one single lid from the first plurality of lids through an opening of a first throat plate selected from a plurality of throat plates and aligned with the magazine lane, and affixing the at least one single lid to at least one corresponding receiving container. The method also includes adapting at least one of the magazine lane or the first throat plate so as to accommodate the second plurality of lids. The method further includes feeding the second plurality of lids to the at least one magazine lane, aligning the second plurality of lids to one another, passing at least one single lid from the second plurality of lids through an opening of a throat plate selected from the plurality of throat plates, and affixing the at least one single lid to at least one corresponding receiving container.

BRIEF DESCRIPTION OF THE DRAWINGS

The accompanying drawings, which are incorporated in and constitute a part of this specification, illustrate embodiments of the invention and, together with a general description of the invention given above and the detailed description given below, serve to explain the principles of the invention.

DETAILED DESCRIPTION OF THE DRAWINGS

Unless clearly defined otherwise from the context, any range of values presented in the following Detailed Description and Claims includes each end point as well as each whole number or fractional part thereof, within the recited range. Additionally, approximating language may be applied to modify any quantitative representation that may vary without resulting in a change in the basic function to which it is related. Accordingly, a value modified by a term or terms, such as "about" and "substantially," may not be limited to the precise value specified.

If appearing herein, the term "comprising," or derivatives thereof, is not intended to exclude the presence of any additional component, step, or procedure, whether or not the same is disclosed herein. In order to avoid any doubt, all compositions claimed herein through use of the term "comprising" may include any additional additive, adjuvant, or compound, unless stated to the contrary. The terms "comprising" and "including" (or derivatives thereof) are intended to be synonyms. In contrast, the term, "consisting essentially of" if appearing herein, excludes from the scope of any succeeding recitation any other component, step or procedure, excepting those that are not essential to operability. The term "consisting of," if used, excludes any component, step, or procedure not specifically delineated or listed. The term "or," unless stated otherwise, refers to the listed members individually as well as in any combination.

Figure 1:
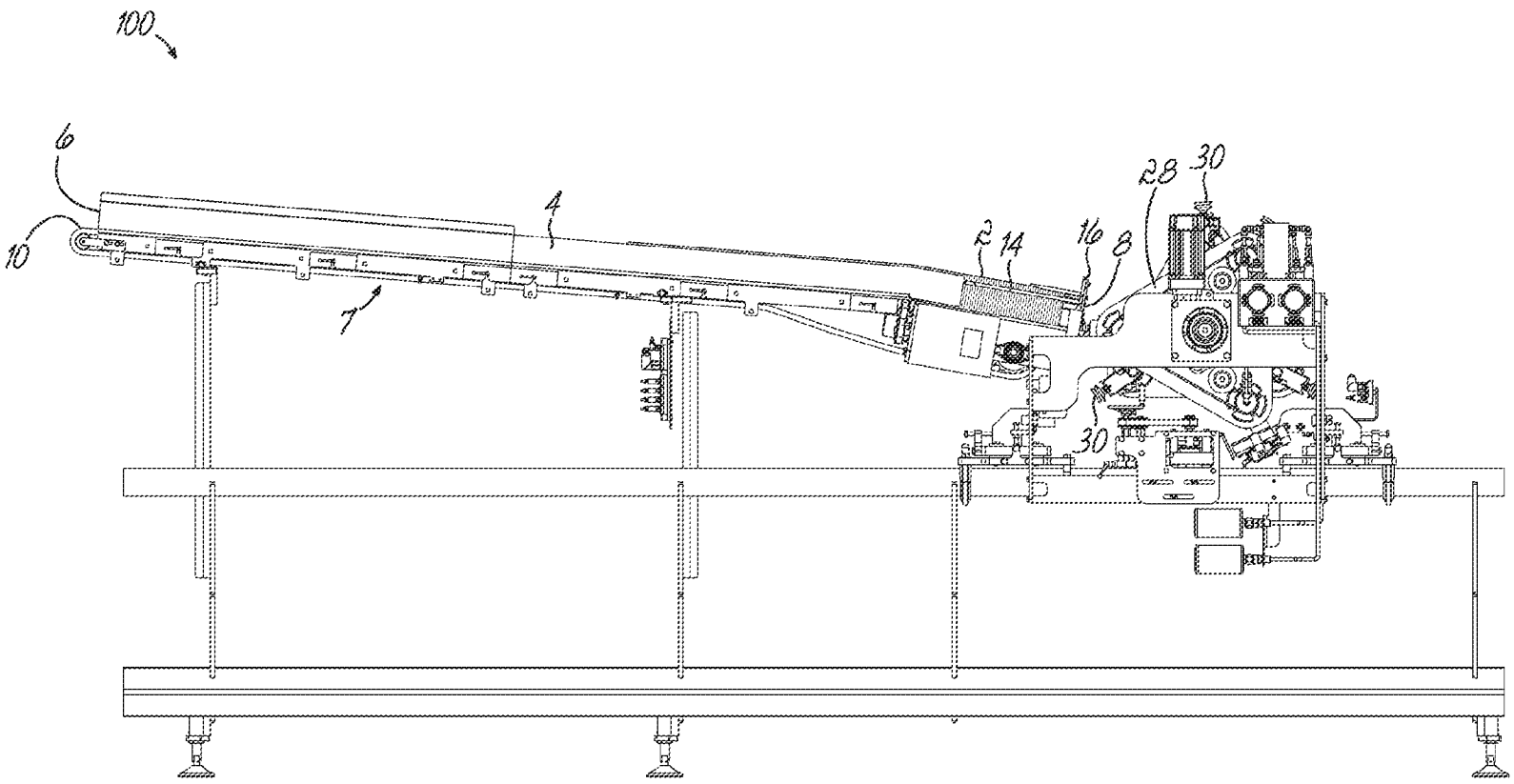
FIG. 1 shows an embodiment of an apparatus for dispensing lids.
Figure 2:
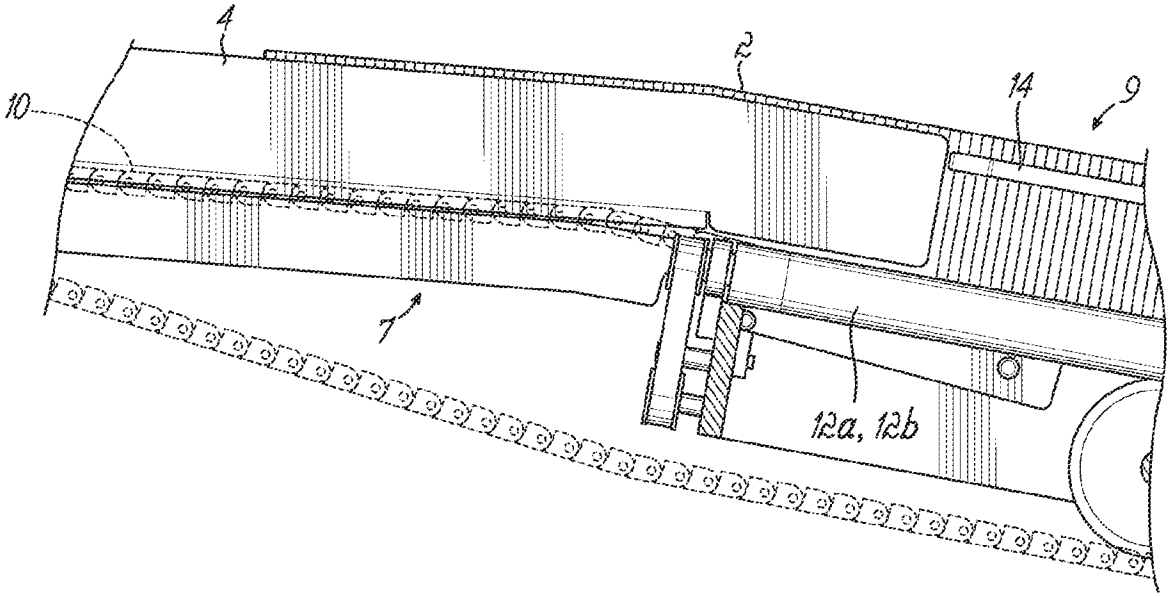
FIG. 2 shows an embodiment of a feeding mechanism of an apparatus for dispensing lids.

Turning to the figures, and as best shown in FIGS. 1 and 2, in an exemplary embodiment, the lids 2 come to the apparatus 100 in stacks and are loaded onto a magazine lane 4. Each magazine lane 4 may include an entrance end 6 and an exit end 8. The magazine lane 4 may include a first run extending in a first plane and a second run extending in a second plane. For instance, proximal to the entrance end 6, the magazine lane 4 may be substantially horizontal, i.e. there is a horizontal run 7, but proximal to the exit end 8, the magazine lane 4 may be angled relative to the horizontal run 7, i.e. there is an angled run 9.

Lids 2 are placed onto a driven belt 10 at the entrance end 6. The driven belt 10 may be in the form of an infeed chain, as shown in the figures, but other driven feeding systems known to those of ordinary skill in the art, such as a conveyor belt or other suitable feeding mechanism, may be utilized as well to achieve the same result.

Figure 3:
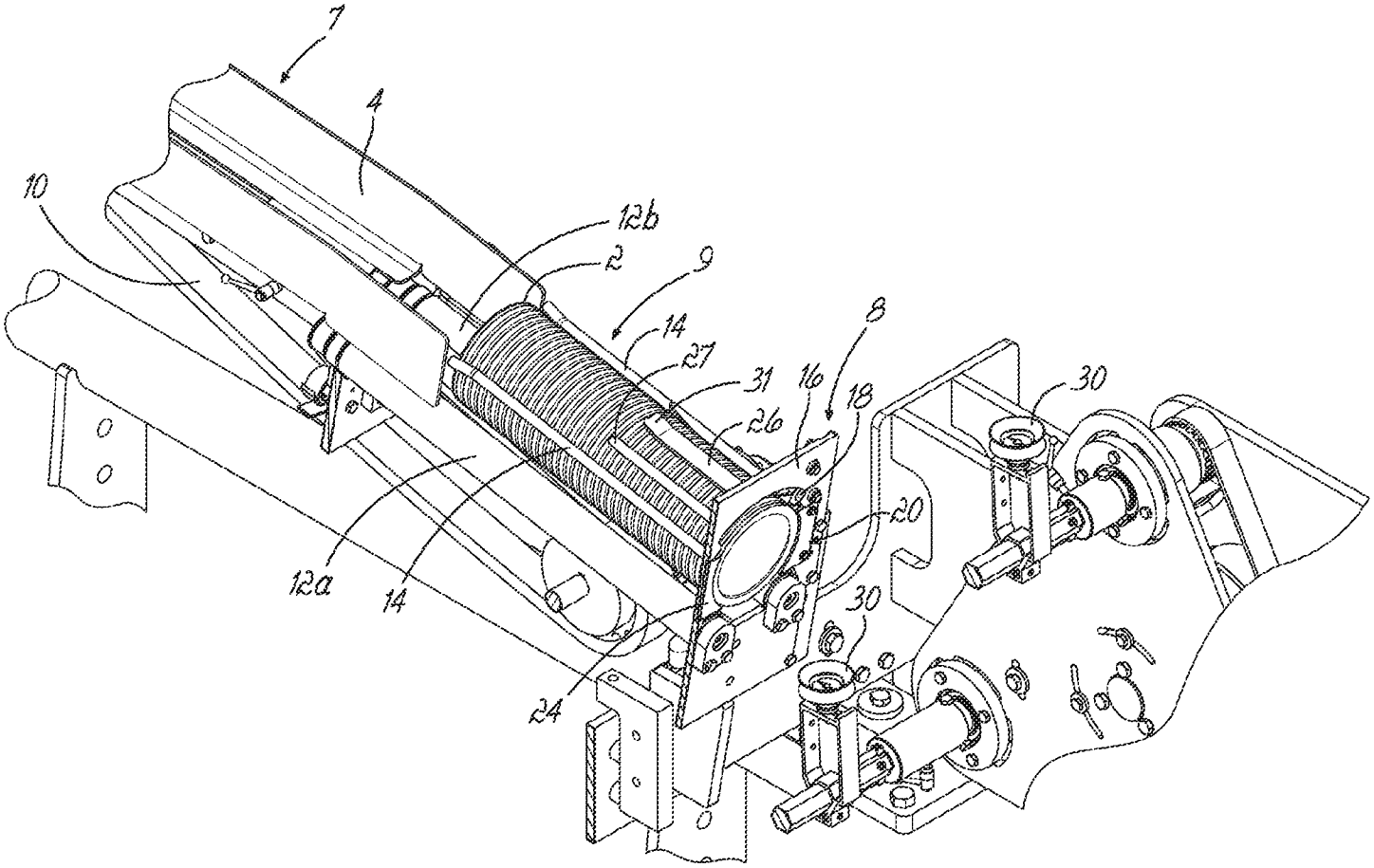
FIG. 3 shows an embodiment of a feeding mechanism of an apparatus for dispensing lids.

As best shown in FIG. 3, the driven belt 10 conveys the lids 2 onto a pair of spinning rollers 12*a*, 12*b* set at an adjustable angle relative to the ground so that gravity may help the movement of the lids 2 from the entrance end 6 to the exit end 8 while also allowing flexibility in the positioning of the apparatus 100. In addition to gravity, various mechanisms known in the art may be used to control the feed rate of the lids 2 to minimize back pressure issues in the area of the spinning rollers 12*a*, 12*b*. For example, the feed rate of the driven belt 10 may be suitably adjusted such that the desired backpressure in the angled run 9 is controlled. In addition, or alternatively, the angle of the angled run 9 may be suitably adjusted to achieve the same result. It is contemplated that one or more sensors, such as optical sensors, may be located proximate the transition shoe (not shown), as described below, to monitor the profile or pattern of the transfer "wave" of the lids 2 as they transition from the horizontal run 7 to the angled run 9. The sensors may monitor the spacing between adjacent lids 2 and/or the angle of one or more lids 2 as they transition from the horizontal run 7 to the angled run 9. By effectively controlling the feed rate by monitoring the profile or pattern of the transfer "wave" of the lids 2, a desired backpressure of the lids 2 upstream of the exit end 8 may be suitably controlled.

The magazine lane 4 may include a transfer shoe (not shown) located at the transition from the horizontal run 7 to the angled run 9 that the driven belt 10 may pass across, which transfer shoe generally defines the path of travel of the driven belt 10, and ultimately, of the lids 2. Additionally, the magazine lane 4 may include fixed transition rails (not shown) for the transition from the driven belt 10 to the spinning rollers 12*a*, 12*b*. Additionally, the rate at which the lids 2 are extracted from the apparatus 100 and the rate at which the lids 2 are fed to the angled run 9 may be generally matched so that there generally is no delay near the transition between the horizontal run 7 and the angled run 9. These generally identical rates of feed are not required in all circumstances, however. One of ordinary skill in the art can optimize the two rates based on the needs of usage specifications.

The magazine lane 4 further includes side guides 14 on either side of the magazine lane 4. The position of the side guides 14 may be adjusted to accommodate the shape of the lids 2 being used, as can be the lateral spacing of the spinning rollers 12*a*, 12*b* relative to each other. These adjustments may be made using suitable adjustment mechanisms known to those of ordinary skill in the art, such as through threaded nuts and bolts in appropriate slots on the apparatus.

Spinning rollers 12*a*, 12*b* help the lids 2 to axially align by causing the lids 2 to spin at a determined speed as they approach the magazine throat plate 16 (hereinafter "throat plate 16"). For rectangular and scround lids, these spinning rollers 12*a*, 12*b* are not necessarily required to spin. This is because a stack of round lids moves more freely than a stack of either scround lids or rectangular lids, and the spinning of the spinning rollers 12*a*, 12*b* helps maintain integrity of the stack of round lids. The spinning rollers 12*a*, 12*b* may be operated by one or more servo motors or by various other suitable drive mechanisms known in the art.

In normal operation, the spinning rollers 12*a*, 12*b* may spin in the same direction. However, if the lids 2 become jammed or too much backpressure is exerted on the system, each spinning roller 12*a*, 12*b* may spin in opposite directions, so that the spinning rollers 12*a*, 12*b* jostle the lids 2 within the angled run 9. The spinning rollers 12*a*, 12*b* may be operated in this manner either alternately or simultaneously. Thus, one spinning roller, e.g. 12*a*, may spin in a clockwise direction, and the other spinning roller, e.g. 12*b*, may spin in a counter-clockwise direction. This counter-rotation will allow the jam to be cleared with minimal aid from a human operator. Additionally, the two spinning rollers 12*a*, 12*b* may be operated at different rates of speed (i.e., RPMs).

Figure 4:
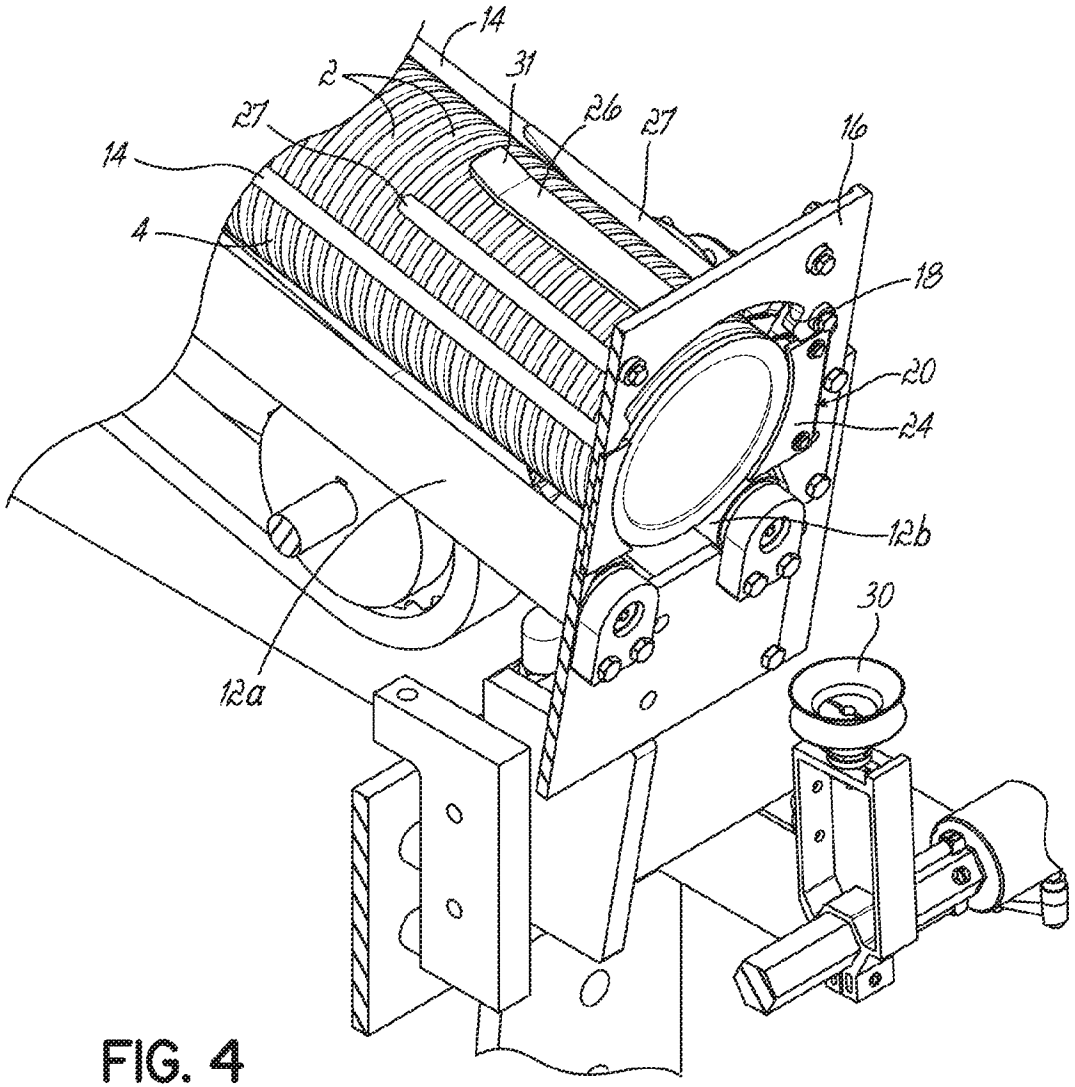
FIG. 4 is a detailed view of FIG. 3.
Figure 5:
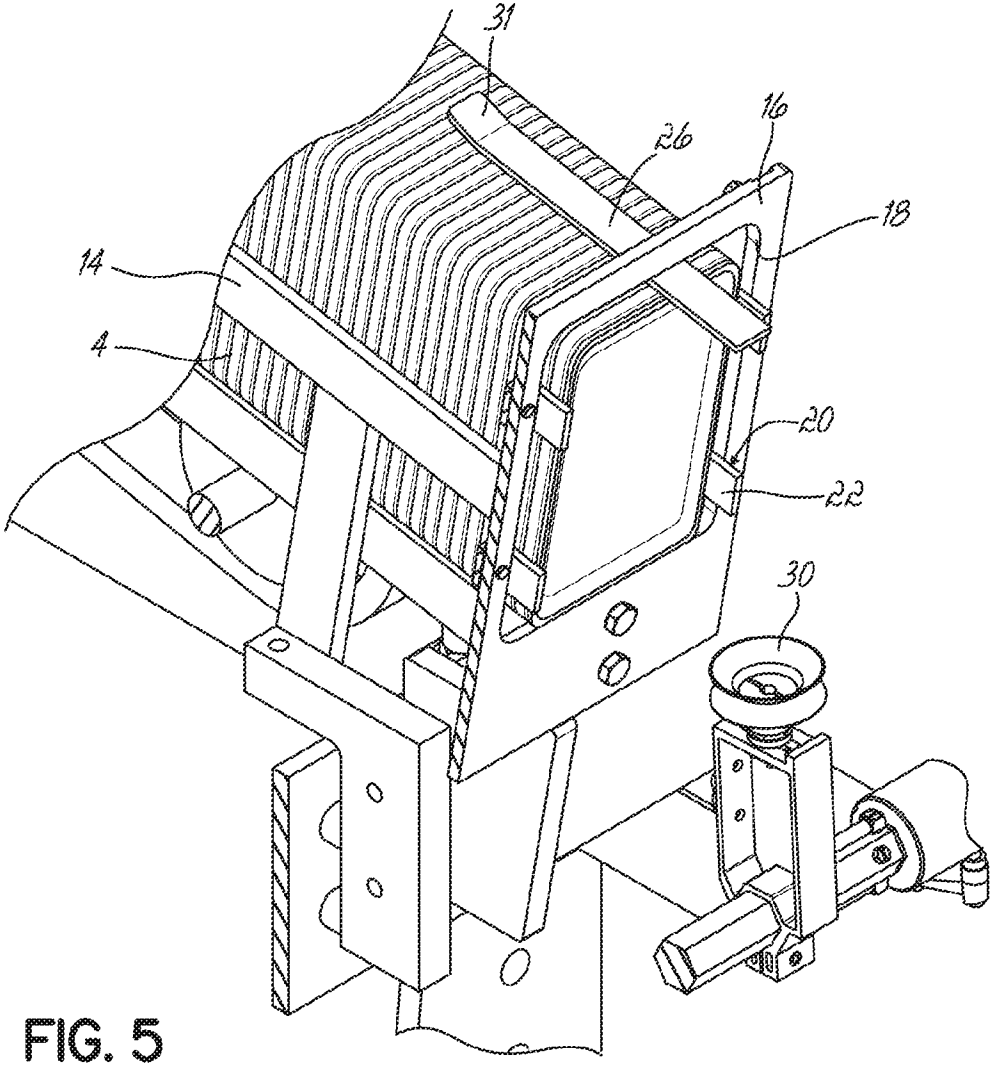
FIG. 5 shows an embodiment of a feeding mechanism of an apparatus for dispensing lids.
Figure 6:
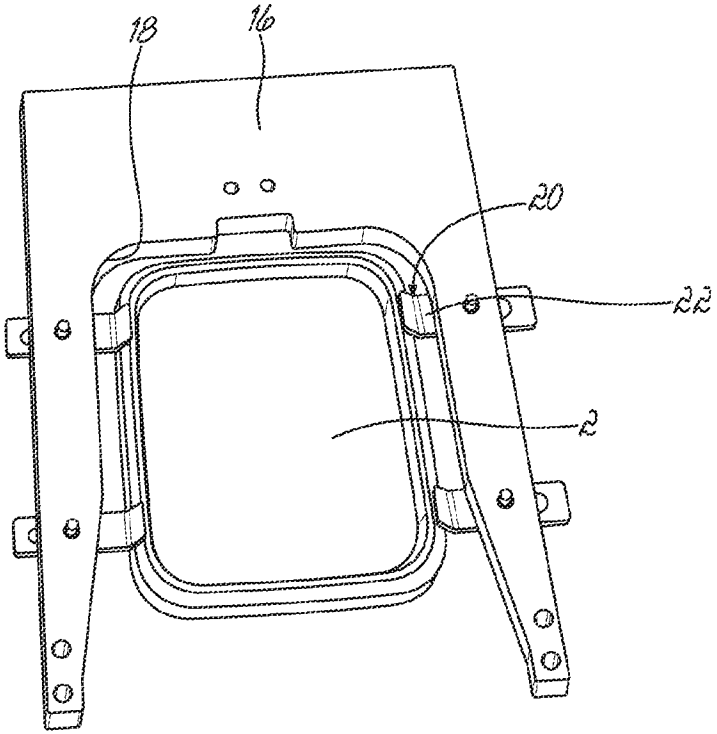
FIG. 6 shows an embodiment of a throat plate adapted for non-circular lids.

Throat plate 16 is designed specifically for the size and type of lid to be used on the receiving container (not shown). In particular, and as shown in FIG. 4, throat plate 16 includes an aperture or an opening 18 designed to accommodate the particular lid shape and size being used. FIG. 4 shows a throat plate 16 for round lids, while FIGS. 5 and 6 show a throat plate 16 for lids with shapes other than round, such as rectangular or scround lids. Although one throat plate 16 for round lids and a different throat plate 16 for rectangular and scround lids are shown herein, it is contemplated that one universal throat plate (not shown) could be utilized that is configured to accommodate round, scround, and rectangular lids in appropriate circumstances.

Hold back tabs 20 may be used to hold the lids 2 in place as they pass through opening 18 of throat plate 16. These hold back tabs 20 may take the form of substantially rectangular tabs 22, as shown in FIG. 6, or half round tabs 24 as shown in FIG. 3. Additionally, tab 26 may apply downward pressure on the stack of lids 2 as the lids 2 approach and move through opening 18. The hold back tabs 20 and tab 26 may be rigid, such as made of metal and/or be made of a flexible material, and thus allow minimal movement of the lids 2 when the lids 2 are fed through the magazine lane 4.

Figure 7:
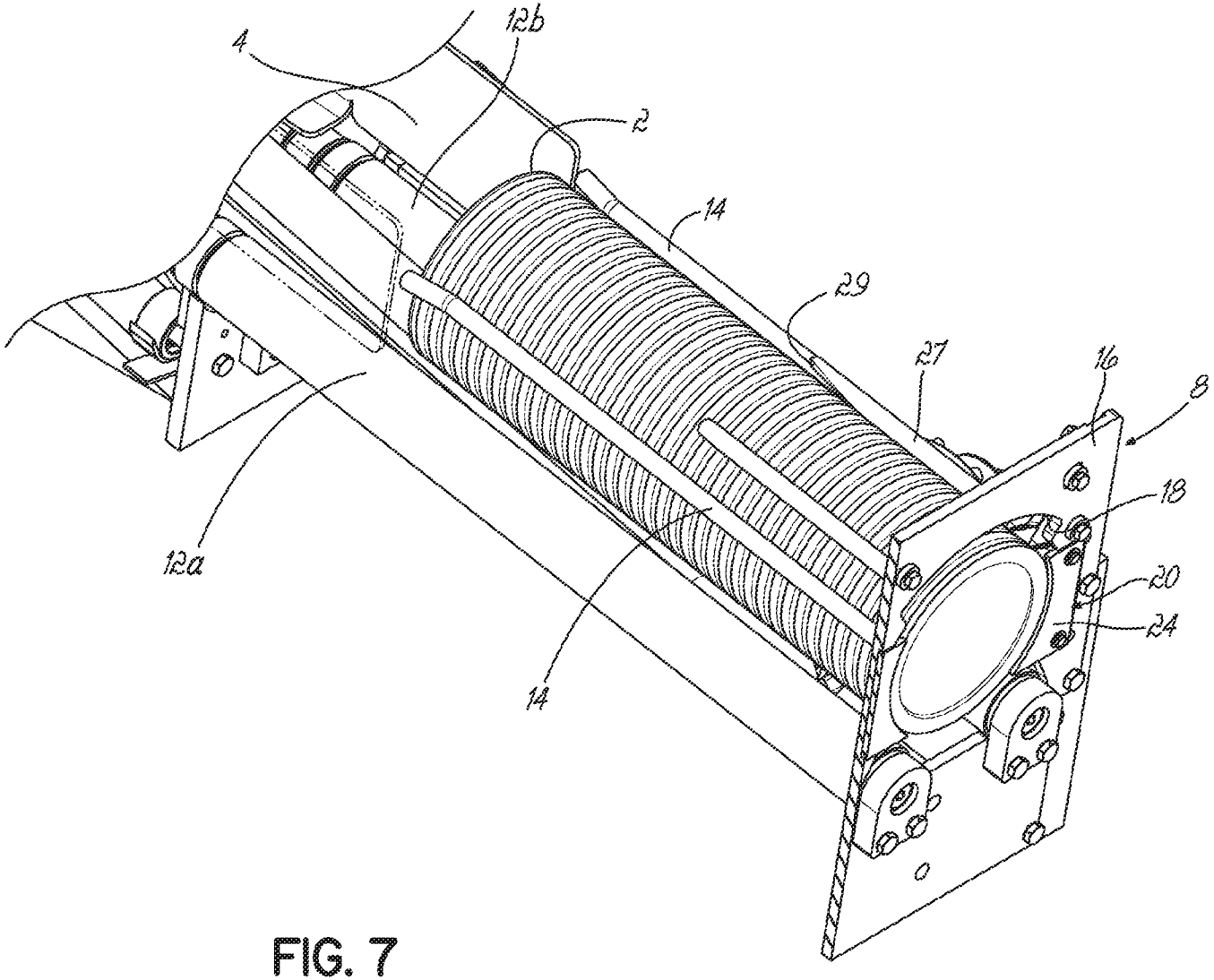
FIG. 7 shows an alternative embodiment of a throat plate adapted for round lids.

As shown in FIG. 7, additional tabs 27 may be used to funnel the lids 2 into the exit end 8 of the magazine lane 4. These additional tabs 27 may be generally planar or may contain features that aid in funneling the lids 2. For instance, additional tabs 27 of FIG. 7 may include a beveled edge 29, and tab 26, shown in FIGS. 3 and 4, may include a bent or upturned feature 31, all of which aid in this funneling and proper alignment of the lids 2 as they approach the exit end 8 of the magazine lane 4.

After the lids 2 approach the opening 18 of the throat plate 16, an orbital article feeder 28 then picks up the lids 2 with a vacuum cup 30 from the magazine lane 4 at the throat plate 16, as shown in FIG. 5. The lids 2 may be picked and deposited in one of at least three ways. In the first method, a lid may be picked and deposited onto a receiving plate (not shown) where the cup (not shown) may grab the edge of a single lid and then pull the lid under an affixing shoe (not shown) during indexing. In the second method, the lid may be picked and then placed directly onto a leading edge of a cup (not shown). In this method, affixing the lid to the cup (not shown) may be accomplished by pulling the lid under an affixing shoe (not shown) during indexing. In the third method, the rotary feed of the orbital article feeder 28 may place the lid directly on the cup (not shown). No affixing shoe is necessary in this method. Under any method, the location of attachment of vacuum cup 30 to the lids 2 at the throat plate 16 may be precisely controlled because the lids 2 do not have an appreciable freedom of motion at or near the throat plate 16 due to the tabs 20, 22, 26, and 27.

Figure 8:
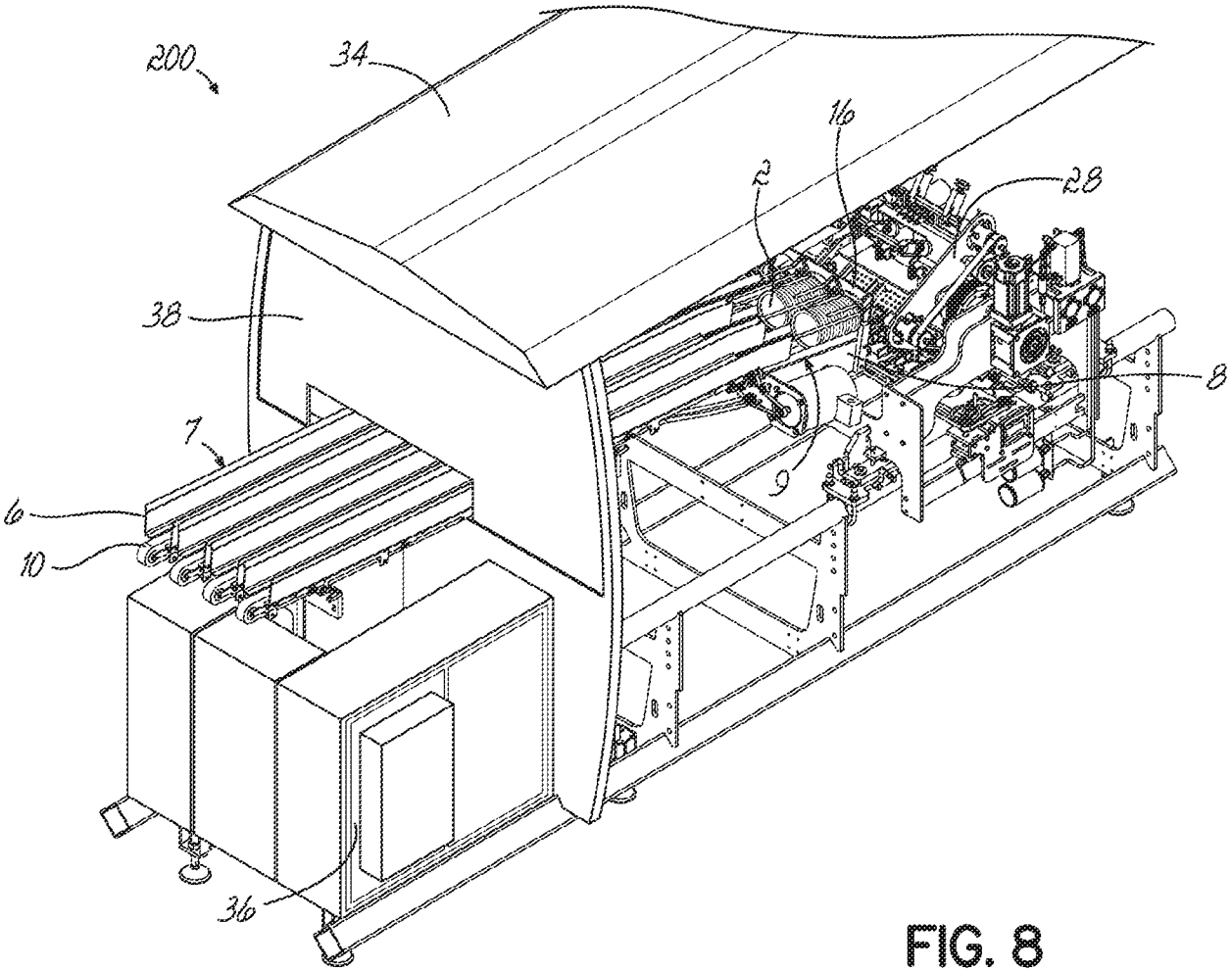
FIG. 8 shows an embodiment of an apparatus for dispensing lids in an overcapper system.

FIG. 8 shows an embodiment of the apparatus for dispensing lids in the context of an operational overcapper system 200. The system is mostly contained within a housing 34. However, driven belt 10 near the entrance end 6 is located outside the housing 34 just over the control box 36. This allows the operator to replenish the supply of lids 2, while standing behind guard wall 38 of housing 34, without being exposed to the movable parts of the overcapper system 200 (except for the driven belt 10). Also, this configuration allows for automation of lid replenishment onto the horizontal run 7 of the apparatus 100.

The apparatus 100 may be adjusted for different sizes of lids 2 and also for lids 2 of different shapes. For instance, the spacing between both the side guides 14 and the spinning rollers 12*a*, 12*b* may be adjusted to accommodate different sizes of lids 2. Further, the appropriate throat plate 16, which is easily removed and attached through the use of securing mechanisms known to one of ordinary skill in the art (e.g., threaded nuts and bolts), may be used to accommodate both the size and shape of the lids 2. The throat plate 16 may also include apertures (not shown) that set the lateral spacing between the spinning rollers 12*a*, 12*b* by allowing the end of the spinning rollers 12*a*, 12*b* proximal to the throat plate to form a connection with suitable apertures in the throat plate 16. In this way, the spacing of the apertures in the throat plate 16 defines the lateral spacing between the spinning rollers 12*a*, 12*b*.

The disclosed apparatus and method will greatly improve the operation and reliability of the overcapping function as well as make it possible to utilize different style lids on the same machine. Indeed, switching between lid styles is easily facilitated in accordance with the disclosed apparatus and method, due in large part to the adjustable nature of the throat plate 16 and the side guides 14. Additionally, the horizontal run 7 of the magazine lane 4 is ergonomically advantaged relative to prior feeding systems because it allows for replenishment of the lids 2 without the need to reach upward and allows for longer run times between lid replenishments.

While the present invention has been illustrated by a description of various preferred embodiments and while these embodiments have been described in some detail, it is not the intention of the inventors to restrict or in any way limit the scope of the appended claims to such detail. Additional advantages and modifications will readily appear to those skilled in the art. The various features of the invention may be used alone or in any combinations depending on the needs and preferences of the user.

What is claimed:

1. An apparatus for dispensing lids, comprising:

at least one magazine lane including an entrance end, an exit end, and a longitudinal length defined therebetween along a longitudinal axis of the at least one magazine lane, the at least one magazine lane further including a plurality of side guides along the longitudinal length for guiding the lids therebetween and a pair of rollers each having a rotational axis parallel to the longitudinal axis of the at least one magazine lane and being disposed along the longitudinal length for carrying the lids thereon; and a throat plate at or near the exit end, the throat plate including an opening;

wherein at least one of the throat plate or the rollers is adaptable so as to accommodate different sizes and/or shapes of lids.

2. The apparatus of claim 1, wherein the throat plate is a universal throat plate configured to accommodate different sizes and/or shapes of lids in order to provide adaptability to the throat plate.

3. The apparatus of claim 1, wherein the throat plate is removably attachable to the at least one magazine lane at or near the exit end thereof such that the throat plate is exchangeable with a different throat plate in order to provide adaptability to the throat plate.

4. The apparatus of claim 1, wherein the rollers are movable relative to each other to adjust a spacing therebetween in order to provide adaptability to the rollers.

5. The apparatus of claim 1, wherein the throat plate includes first and second apertures for receiving corresponding ends of the rollers for defining a spacing between the rollers.

6. The apparatus of claim 1, wherein at least one of the rollers is a spinning roller.

7. The apparatus of claim 6, wherein each of the rollers is a spinning roller, and wherein the rollers spin in the same direction.

8. The apparatus of claim 6, wherein each of the rollers is a spinning roller, and wherein the rollers spin in opposite directions.

9. The apparatus of claim 1, wherein the lids are one of round, rectangular, and scround.

10. The apparatus of claim 1, wherein the throat plate includes at least one hold back tab extending inwardly from a periphery of the opening for aligning the lids as the lids pass through the opening.

11. The apparatus of claim 1, wherein the at least one magazine lane further includes at least one of a belt or a chain adapted to feed the lids to the rollers.

12. The apparatus of claim 1, wherein the at least one magazine lane includes a plurality of magazine lanes.

13. The apparatus of claim 1, wherein the at least one magazine lane includes a first run extending in a first plane and a second run extending in a second plane, the first run being proximal to the entrance end and the second run being proximal to the exit end.

14. The apparatus of claim 13, wherein the second plane is angled relative to horizontal.

15. An apparatus for dispensing lids, comprising:

at least one magazine lane including an entrance end, an exit end, and a longitudinal length defined therebetween along a longitudinal axis of the at least one magazine lane, the at least one magazine lane further including a plurality of side guides along the longitudinal length for guiding the lids therebetween and a pair of rollers each having a rotational axis parallel to the longitudinal axis of the at least one magazine lane and being disposed along the longitudinal length for carrying the lids thereon; and a throat plate at or near the exit end, the throat plate including an opening;

wherein the side guides are movable relative to each other to adjust a spacing therebetween in order to provide adaptability to the side guides so as to accommodate different sizes and/or shapes of lids.

16. The apparatus of claim 15, wherein the throat plate is a universal throat plate configured to accommodate different sizes and/or shapes of lids in order to provide adaptability to the throat plate.

17. The apparatus of claim 15, wherein the throat plate is removably attachable to the at least one magazine lane at or near the exit end thereof such that the throat plate is exchangeable with a different throat plate in order to provide adaptability to the throat plate.

18. The apparatus of claim 15, wherein the rollers are movable relative to each other to adjust a spacing therebetween in order to provide adaptability to the rollers.

* * * * *